US009359845B2

(12) United States Patent
Grodem et al.

(10) Patent No.: US 9,359,845 B2
(45) Date of Patent: Jun. 7, 2016

(54) SUBSEA CONDUCTOR ANCHOR

(76) Inventors: Kristoffer Grodem, Tau (NO); Hallvard Svadberg Hatloy, Tananger (NO); Sean B. Yakeley, Houston, TX (US); Mona Desai, Houston, TX (US); Brad T. Easley, Kingwood, TX (US); Njaal Hove, Klepp (NO)

( * ) Notice: Subject to any disclaimer, the term of this patent is extended or adjusted under 35 U.S.C. 154(b) by 110 days.

(21) Appl. No.: 13/402,129

(22) Filed: Feb. 22, 2012

(65) Prior Publication Data

US 2012/0211232 A1 Aug. 23, 2012

Related U.S. Application Data

(60) Provisional application No. 61/445,500, filed on Feb. 22, 2011.

(51) Int. Cl.

| | |
|---|---|
| ***E21B 29/12*** | (2006.01) |
| ***E21B 41/04*** | (2006.01) |
| ***E21B 23/06*** | (2006.01) |
| ***E21B 33/14*** | (2006.01) |
| ***E21B 33/124*** | (2006.01) |
| ***E21B 33/129*** | (2006.01) |

(52) U.S. Cl.

CPC ..... *E21B 23/06* (2013.01); *E21B 33/1243* (2013.01); *E21B 33/1294* (2013.01); *E21B 33/143* (2013.01); *E21B 41/04* (2013.01)

(58) Field of Classification Search

CPC ..... E21B 33/14; E21B 23/06; E21B 33/1243; E21B 33/143

USPC ..... 166/285, 289, 290, 350, 368, 359, 386, 166/387

See application file for complete search history.

(56) References Cited

U.S. PATENT DOCUMENTS

| | | | | |
|---|---|---|---|---|
| 1,381,645 | A * | 6/1921 | Kinniear | 166/253.1 |
| 2,182,251 | A | 12/1939 | Crickmer et al. | |
| 2,222,014 | A | 11/1940 | Baker | |
| 2,228,242 | A | 1/1941 | Baker | |
| 2,519,116 | A | 8/1950 | Crake | |
| 2,656,891 | A | 10/1953 | Toelke | |

(Continued)

FOREIGN PATENT DOCUMENTS

| | | |
|---|---|---|
| EP | 0237662 A1 | 9/1987 |
| EP | 0959226 A2 | 11/1999 |

(Continued)

OTHER PUBLICATIONS

PCT Search Report and Written Opinion for International Application No. PCT/US2012/026143 dated Jun. 24, 2013.

(Continued)

*Primary Examiner* — James G Sayre

(74) *Attorney, Agent, or Firm* — Patterson & Sheridan, LLP

(57) ABSTRACT

A method of completing a subsea wellbore includes providing one or more conductor anchoring assemblies on an outer surface of a conductor; forming the subsea wellbore; positioning the conductor in the subsea wellbore; and energizing the one or more conductor anchoring assemblies into contact with the subsea wellbore, thereby stabilizing the conductor in the subsea wellbore. In yet another embodiment, the method further includes extending the subsea wellbore; positioning a casing inside the conductor, wherein the casing includes a casing anchoring assembly; and energizing the casing anchoring assembly into contact with the conductor.

17 Claims, 13 Drawing Sheets

(56) References Cited

U.S. PATENT DOCUMENTS

| | | | | | |
|---|---|---|---|---|---|
| 2,988,148 | A | | 6/1961 | Conrad et al. | |
| 3,002,561 | A | | 10/1961 | Baker et al. | |
| 3,054,450 | A | | 9/1962 | Baker | |
| 3,061,013 | A | | 10/1962 | Thomas, Jr. | |
| 3,180,419 | A | | 4/1965 | Cochran et al. | |
| 3,194,312 | A | * | 7/1965 | Thomas | 166/285 |
| 3,298,440 | A | | 1/1967 | Current | |
| 3,374,840 | A | | 3/1968 | Current | |
| 3,412,802 | A | | 11/1968 | Kisling, III | |
| 3,459,261 | A | | 8/1969 | Cochran | |
| 3,467,184 | A | | 9/1969 | Young | |
| 3,507,327 | A | | 4/1970 | Chenoweth | |
| 3,527,299 | A | * | 9/1970 | Lewis | 166/184 |
| 3,623,551 | A | | 11/1971 | Randermann, Jr. | |
| 3,678,998 | A | | 7/1972 | Cockrell et al. | |
| 3,976,133 | A | | 8/1976 | Allen | |
| 4,018,274 | A | | 4/1977 | Cochran | |
| 4,078,606 | A | | 3/1978 | Montgomery | |
| 4,146,093 | A | | 3/1979 | Horvath et al. | |
| 4,153,109 | A | | 5/1979 | Szescila | |
| 4,216,827 | A | | 8/1980 | Crowe | |
| 4,253,676 | A | | 3/1981 | Baker et al. | |
| 4,289,200 | A | | 9/1981 | Fisher, Jr. | |
| 4,300,775 | A | | 11/1981 | Ringel | |
| 4,345,649 | A | | 8/1982 | Baugh et al. | |
| 4,353,420 | A | | 10/1982 | Miller | |
| 4,375,240 | A | | 3/1983 | Baugh et al. | |
| 4,403,660 | A | | 9/1983 | Coone | |
| 4,406,469 | A | | 9/1983 | Allison | |
| 4,436,150 | A | | 3/1984 | Barker | |
| 4,444,252 | A | | 4/1984 | Fisher, Jr. | |
| 4,452,463 | A | | 6/1984 | Buckner | |
| 4,457,369 | A | | 7/1984 | Henderson | |
| 4,487,258 | A | | 12/1984 | Jackson et al. | |
| 4,499,947 | A | | 2/1985 | Zsoka et al. | |
| 4,537,251 | A | | 8/1985 | Braddick | |
| 4,540,047 | A | | 9/1985 | Akkerman | |
| 4,600,056 | A | * | 7/1986 | Burton, Jr. | 166/291 |
| 4,604,351 | A | | 8/1986 | Amaral | |
| 4,662,450 | A | | 5/1987 | Haugen | |
| 4,703,813 | A | * | 11/1987 | Sieler | 175/5 |
| 4,708,202 | A | | 11/1987 | Sukup et al. | |
| 4,730,670 | A | | 3/1988 | Kim | |
| 4,749,035 | A | | 6/1988 | Cassity | |
| 4,753,444 | A | | 6/1988 | Jackson et al. | |
| 4,784,226 | A | | 11/1988 | Wyatt | |
| 4,834,175 | A | | 5/1989 | Ross et al. | |
| 4,898,239 | A | | 2/1990 | Rosenthal | |
| 5,035,813 | A | * | 7/1991 | Shen | 507/211 |
| 5,044,441 | A | | 9/1991 | Rubbo et al. | |
| 5,082,062 | A | | 1/1992 | Wood et al. | |
| 5,103,901 | A | | 4/1992 | Greenlee | |
| 5,165,703 | A | | 11/1992 | Morvant | |
| 5,226,492 | A | | 7/1993 | Solaeche P. et al. | |
| 5,226,494 | A | | 7/1993 | Rubbo et al. | |
| 5,311,938 | A | | 5/1994 | Hendrickson et al. | |
| 5,366,019 | A | | 11/1994 | Brooks | |
| 5,396,954 | A | | 3/1995 | Brooks | |
| 5,433,269 | A | | 7/1995 | Hendrickson | |
| 5,458,194 | A | * | 10/1995 | Brooks | 166/285 |
| 5,542,473 | A | | 8/1996 | Pringle | |
| 5,615,741 | A | | 4/1997 | Coronado | |
| 5,620,050 | A | | 4/1997 | Barbee | |
| 5,636,689 | A | | 6/1997 | Rubbo et al. | |
| 5,676,384 | A | | 10/1997 | Culpepper | |
| 5,678,635 | A | | 10/1997 | Dunlap et al. | |
| 5,692,564 | A | | 12/1997 | Brooks | |
| 5,749,585 | A | | 5/1998 | Lembcke | |
| 5,775,429 | A | | 7/1998 | Arizmendi et al. | |
| 5,787,987 | A | | 8/1998 | Forsyth et al. | |
| 5,819,846 | A | | 10/1998 | Bolt, Jr. | |
| 5,819,854 | A | | 10/1998 | Doane et al. | |
| 5,833,001 | A | | 11/1998 | Song et al. | |
| 5,857,520 | A | | 1/1999 | Mullen et al. | |
| 5,941,313 | A | | 8/1999 | Arizmendi | |
| 6,009,951 | A | | 1/2000 | Coronado et al. | |
| 6,041,858 | A | | 3/2000 | Arizmendi | |
| 6,102,117 | A | | 8/2000 | Swor et al. | |
| 6,116,339 | A | | 9/2000 | Milne et al. | |
| 6,244,642 | B1 | | 6/2001 | Serafin et al. | |
| 6,742,598 | B2 | | 6/2004 | Whitelaw et al. | |
| 6,823,945 | B2 | | 11/2004 | Eslinger et al. | |
| 6,988,557 | B2 | | 1/2006 | Whanger et al. | |
| 7,178,603 | B2 | | 2/2007 | Naquin, Sr. et al. | |
| 7,234,546 | B2 | | 6/2007 | Vincent et al. | |
| 2002/0050360 | A1 | * | 5/2002 | Cook et al. | 166/380 |
| 2005/0155775 | A1 | | 7/2005 | Hirth et al. | |
| 2008/0053652 | A1 | | 3/2008 | Corre et al. | |
| 2008/0202771 | A1 | | 8/2008 | Carisella et al. | |
| 2009/0084550 | A1 | * | 4/2009 | Korte et al. | 166/294 |

FOREIGN PATENT DOCUMENTS

| | | | |
|---|---|---|---|
| FR | 2377518 | A1 | 8/1978 |
| GB | 1398038 | A | 6/1975 |
| WO | 2008/082971 | A1 | 7/2008 |
| WO | 2008082971 | | 7/2008 |

OTHER PUBLICATIONS

EPO Office Action dated May 28, 2014 for European Application No. 12707212.2.

Canadian Office Action for Canadian Patent Applicaton No. 2,827,733, dated Aug. 25, 2014.

Canadian Office Action dated Jul. 9, 2015, for Canadian Application No. 2,827,733.

* cited by examiner

SUBSEA CONDUCTOR ANCHOR

CROSS-REFERENCE TO RELATED APPLICATIONS

This application claims benefit of U.S. Provisional Patent Application Ser. No. 61/445,500, filed Feb. 22, 2011, which application is incorporated herein by reference in its entirety.

BACKGROUND OF THE INVENTION

1. Field of the Invention

Embodiments of the present invention generally relate to methods and apparatus for forming a subsea wellbore. More specifically, embodiments of the present invention relate to methods and apparatus for anchoring a conductor or casing in a subsea wellbore.

2. Description of the Related Art

A wellbore for accessing hydrocarbon-bearing formations is typically formed by first drilling to a predetermined depth using a drill string. The drill string is often rotated by a top drive or rotary table on a surface platform or rig, or by a downhole motor mounted towards the lower end of the drill string. After drilling to the predetermined depth, the drill string is removed and a string of casing is lowered into the wellbore. The casing string is temporarily hung from the surface of the well. A cementing operation is then conducted to fill the annular area defined between the outer wall of the casing and the borehole with cement. The combination of cement and casing strengthens the wellbore and facilitates the isolation of certain areas of the formation behind the casing for the production of hydrocarbons.

It is common to employ more than one string of casing in a wellbore. In this respect, the well is drilled to a first designated depth. After removing the drill string, a first string of casing or conductor pipe is then run into the wellbore and set in the drilled out portion of the wellbore. Cement is circulated into the annulus behind the casing string. Next, the well is drilled to a second designated depth, and a second string of casing, or liner, is run into the drilled out portion of the wellbore. The second string is typically set at a depth such that the upper portion of the second string of casing overlaps the lower portion of the first string of casing. The second liner string may then be fixed, or "hung" off of the existing casing by the use of slips which utilize slip members and cones to frictionally affix the new string of liner in the wellbore. The second casing string is then cemented. This process is typically repeated with additional casing strings until the well has been drilled to total depth. In this manner, wells are typically formed with two or more strings of casing.

In the construction of offshore wells, a conductor pipe is typically installed in the earth prior to the placement of other tubulars. The conductor pipe, typically having a 36" or 30" outer diameter ("OD"), is jetted, drilled, or a combination of jetted and drilled into place. Placement depth of the conductor pipe may be approximately from 200 feet to 500 feet below the mud line. The conductor pipe is typically carried in from a drill platform on a drill string that has a bit or jetting head projecting just below the bottom of the conductor pipe, which is commonly referred to as a bottom hole assembly ("BHA"). The conductor pipe is placed in the earth by jetting a hole and if necessary partially drilling and/or jetting a hole while simultaneously carrying the conductor pipe 10 into the hole.

The general procedure for drilling the hole below the conductor pipe to install the structural or surface casing is to drill with a BHA on the end of the drill string used to run the conductor pipe in the hole. Surface casing refers to casing run deep enough to cover most know shallow drilling hazards, yet the casing is typically located above any anticipated commercial hydrocarbon deposits. The BHA will as a minimum consist of a drilling or jetting bit. The BHA may also contain a mud motor, instrumentation for making geophysical measurements, an under reamer, stabilizers, as well as a drill bit or an expandable drill bit. After, the hole is drilled for the next string of casing, the surface casing is run-in and installed concentrically with the conductor.

The conductor, as the outermost casing, handles most of the anchor responsibilities. In many offshore drilling operations, motion or energy from the sea and the drilling activity is transferred through the casings. Because the casings are installed concentrically, the motion or energy is also transferred radially to the conductor. In addition to mechanical movement, the conductor also experiences thermal stretch and contraction associated with the changing temperature of the fluids. Over time, these stresses cause failure of the cement around the conductor as well as fatigue in the casings. A poor cement job also negatively affects the conductor's ability to anchor the casings because of the presence of gaps in the annular area resulting in insufficient contact area with the borehole. Poor cement jobs are more common when cementing near the sea floor where there is more unconsolidated soil. Thus, a conductor is more prone to movement in offshore drilling operations.

A need, therefore, exists for apparatus and methods of anchoring a conductor in a subsea wellbore.

SUMMARY OF THE INVENTION

Embodiments of the present invention provide apparatus and methods of anchoring a conductor in the earth. In one embodiment, the method involves using a conductor anchoring member attached to an upper end of the conductor near the sea floor and energizing the anchoring member into contact with the wellbore. In another embodiment, one or more casings may be positioned inside the conductor and casing anchoring members may be positioned between the one or more casings and the conductor, whereby lateral forces may be transmitted to the conductor and the conductor anchoring members.

In another embodiment, a method of completing a subsea wellbore includes providing one or more conductor anchoring assemblies on an outer surface of a conductor; forming the subsea wellbore; positioning the conductor in the subsea wellbore; and energizing the one or more conductor anchoring assemblies into contact with the subsea wellbore, thereby stabilizing the conductor in the subsea wellbore. In yet another embodiment, the method further includes extending the subsea wellbore; positioning a casing inside the conductor, wherein the casing includes a casing anchoring assembly; and energizing the casing anchoring assembly into contact with the conductor.

In another embodiment, a subsea tubular assembly for use in a subsea wellbore includes a conductor; one or more inflatable anchoring assemblies; and an innerstring having a set of sealing members and an enlarged section configured to inflate the one or more inflatable anchoring assemblies.

In another embodiment, a subsea tubular assembly for use in a subsea wellbore below a sea floor includes a conductor; one or more conductor anchoring assemblies disposed on the exterior of the conductor, wherein the one or more conductor anchoring assemblies are energized into contact with the subsea wellbore; a casing string disposed inside the conductor; and one or more casing anchoring assemblies disposed on the exterior of the casing string, wherein the one or more casing anchoring assemblies are energized into contact with the conductor.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

Embodiments of the present invention provide apparatus and methods of anchoring a conductor in the earth, preferably as part of a subsea drilling operation. In one embodiment, the method involves using a conductor anchoring member attached to an upper end of the conductor and energizing the anchoring member into contact with the wellbore. In another embodiment, a casing may be positioned inside the conductor and a casing anchoring member may be positioned between the casing and the conductor, whereby lateral forces may be transmitted to the conductor and the conductor anchoring member.

Figure 1:
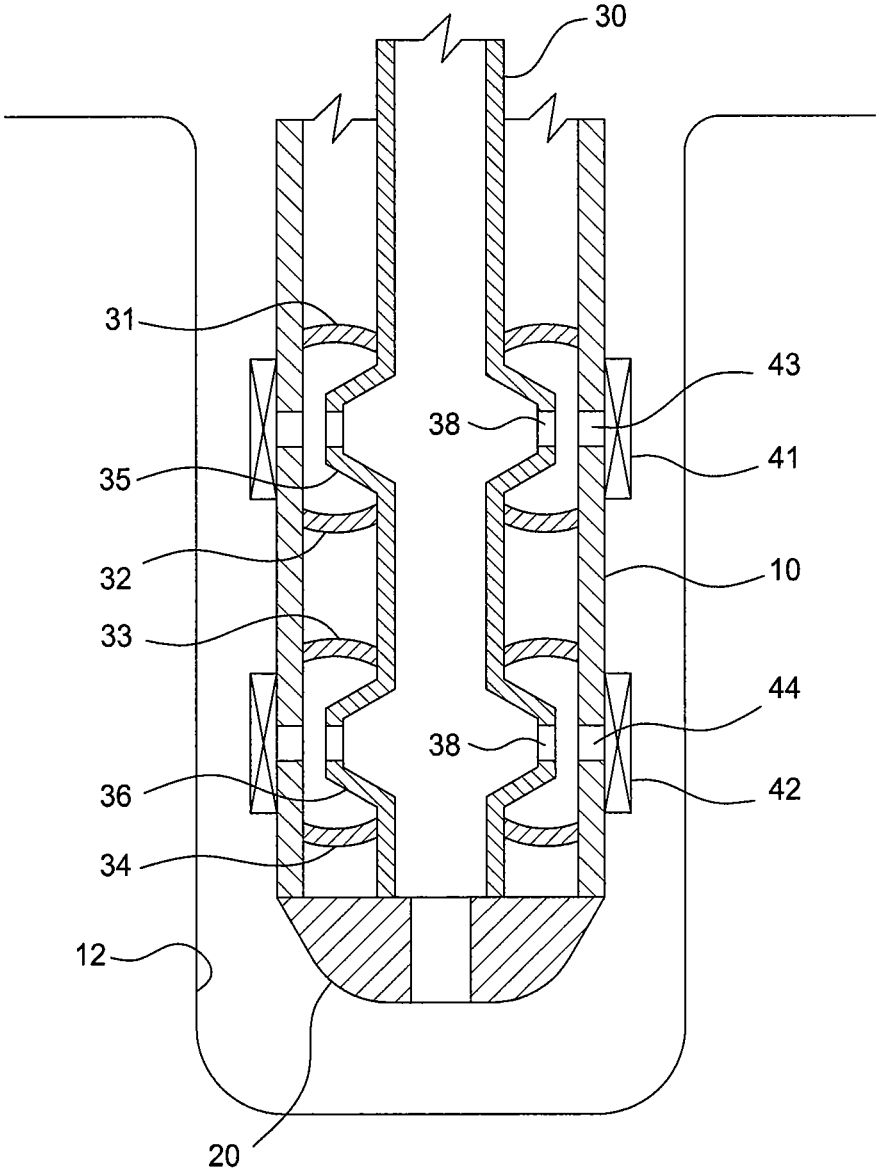
FIG. 1 is a schematic view of an exemplary conductor equipped with a plurality of anchoring assemblies.

FIG. 1 illustrates an exemplary embodiment of a conductor 10 ready to be anchored in the wellbore. As shown, the conductor 10 is positioned in a pre-existing wellbore 12. The wellbore 12 may be formed using a drill string. The lower end of the conductor 10 includes a float shoe 20 to facilitate a cementing operation. The float shoe 20 may include a one way valve to prevent cement from returning into the conductor 10. The conductor may have any suitable diameter size, for example, 36 in. or smaller, such as 36 in., 30 in., or 28 in. The conductor 10 is lowered into the pre-formed wellbore 12 using a drill pipe 30, which is stabbed into the float shoe 20. The process of lowering the conductor may be facilitated when combined with jetting and/or drilling the conductor 10 into the pre-formed wellbore. In another embodiment, the wellbore may be formed simultaneously with lowering the conductor 10 by jetting and/or drilling the conductor 10 into the formation. For example, the conductor 10 may be equipped with a jetting or drilling assembly. A drilling fluid such as sea water or a drilling mud may be pumped down the drill pipe 30 and out of the jetting or drilling assembly. The drilling fluid may have sufficient force to create the borehole to accommodate the conductor 10.

One or more conductor anchoring assemblies 41, 42 may be positioned on the exterior of the conductor 10. As shown, an upper conductor anchoring assembly 41 is positioned proximate an upper end of the conductor 10 and a lower conductor anchoring assembly 42 is positioned proximate a lower end of the conductor 10. It must be noted that providing the second anchoring assembly, such as the lower anchoring assembly 42, is optional. Also, the conductor 10 may optionally include three or more anchoring assemblies. Suitable anchoring assembly includes an inflatable packer. Exemplary inflatable packers include those disclosed in U.S. Pat. Nos. 5,469,919 and 6,202,748 issued to Carisella, as well as U.S. Pat. No. 6,742,598 issued to Whitelaw et al, including description beginning on column 3, line 36 to column 4, line 17, and FIG. 2. Exemplary inflatable packers also include annulus casing packers which are commercially available from Weatherford International, Inc., under the trademark ACP™. Another suitable anchoring assembly includes an anchor having a swellable elastomer. The swellable elastomer increases in volume (i.e., "swell") when it comes into contact with a fluid such as water, hydrocarbon, or a mixture of both. In one embodiment, anchoring assemblies 41, 42 may be configured to enhance gripping engagement with the surrounding formations. For example, the outer surface of the anchoring assemblies 41, 42 may include slips, teeth, or other suitable rough surface to grip the formation.

The conductor 10 may be lowered using an innerstring such as drill pipe 30 that is stabbed into lower portion of the conductor 10. In one embodiment, the drill pipe 30 may be configured to energize the conductor anchoring assemblies 41. 42. As shown, the conductor anchoring assemblies 41, 42 are inflatable anchoring assemblies which are energized by inflation using an inflation medium. The drill pipe 30 includes a set of upper and lower sealing members 31, 32 such as cup packers or other suitable elastomeric seals. If the second anchoring assembly 42 is used, the drill pipe 30 may optionally include a second set of sealing members 33, 34. The sealing members 31, 32, 33, 34 are positioned to straddle the inflation port 43, 44 of the inflatable anchoring assemblies 41, 42 such that inflation fluid from the drill pipe 30 may be directed to the inflatable anchoring assemblies 41, 42. Alternatively, the drill pipe 30 can be moved axially to position one set of sealing members 33, 34 from one anchoring assembly 41 to another anchoring assembly.

The drill pipe 30 may optionally include an enlarged section 35 disposed between the upper and lower sealing members 31, 32. For example, the enlarged section 35 may have an outer diameter larger than the outer diameter of the drill pipe 30. The enlarged section 35 is configured to at least partially fill the annular area between the upper and lower sealing members 31, 32. The enlarged section 35 may have a hollow interior having an inner diameter larger than the outer diameter of the drill pipe. The enlarged section 35 may have a close tolerance fit inside the conductor 10. The enlarged section 35 includes an outlet port 38 to allow fluid to flow into the annular area between the upper and lower sealing members 31, 32. In another embodiment, an optional lower enlarged section 36 may be provided between the upper and lower sealing members 33, 34. In yet another embodiment, the sealing members 31, 32 may be attached to the enlarged section 35 instead of the drill pipe 30. In one embodiment, the drill pipe 30 may have a six to eight inch outer diameter, the enlarged section 35 having at least a twenty inch outer diameter when used to inflate the anchoring assemblies disposed on a conductor.

Figure 2:
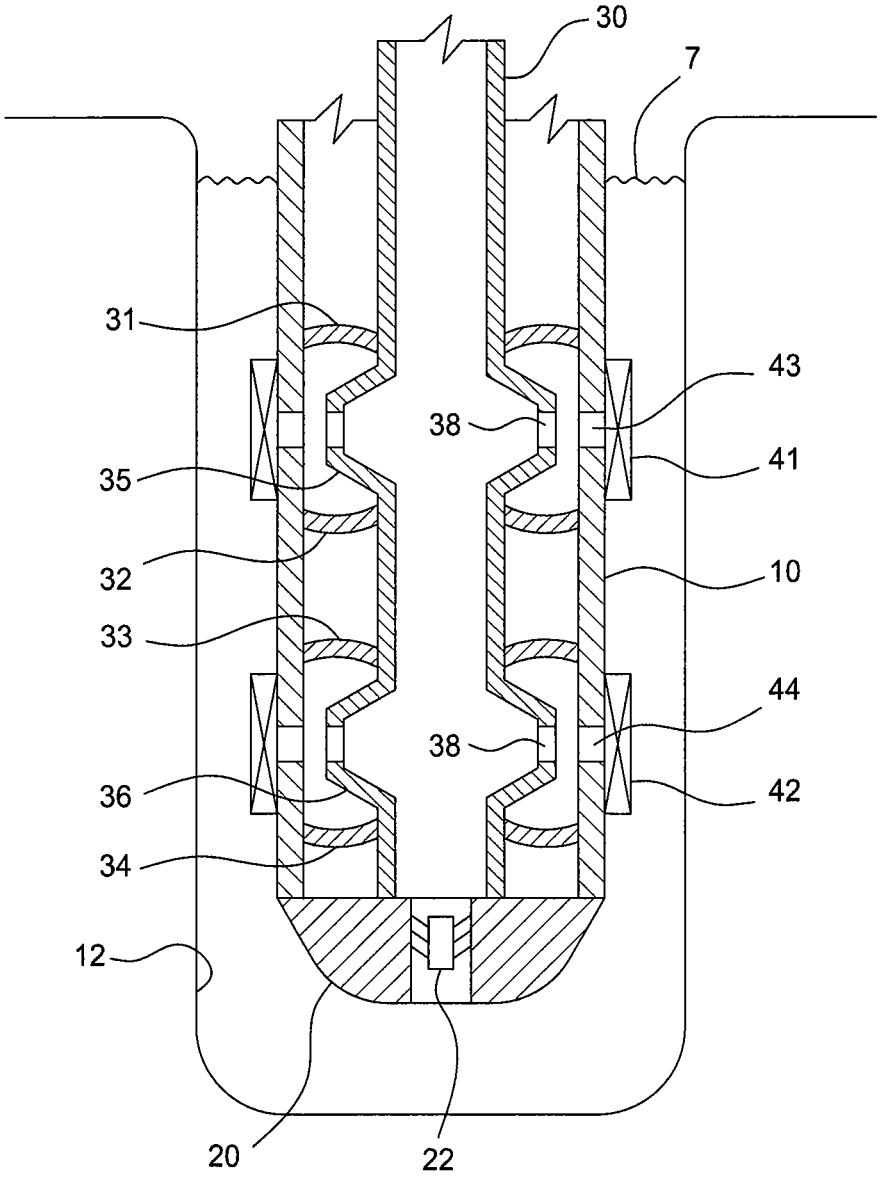
FIGS. 2-3 illustrate sequential operation of installing the conductor of FIG. 1.

In operation, the borehole 12 is formed before the conductor 10 is lowered. The borehole 12 is formed using a drill string rotated by a top drive or rotary table on a surface platform or rig, and/or by a downhole motor mounted towards the lower end of the drill string. After removal of the drill string, the conductor 10 is lowered into the borehole using drill pipe 30, as shown in FIG. 1. In one embodiment, the upper anchoring assembly 41 is located within 1,000 feet of the sea floor; preferably, within 500 feet; more preferably, within 200 feet. Alternatively, the upper anchoring assembly 41 is located at or just below the sea floor. Cement pumped down the drill pipe 30 exits the float shoe 20 and travels up the annulus. After the appropriate amount of cement 7 has been supplied, a shut down plug 22 is disposed behind the cement 7. The plug 22 travels down the drill pipe 30 and lands in the float shoe 20 to close off fluid communication of the drill pipe 30 through the float shoe 30, as shown in FIG. 2.

Figure 3:
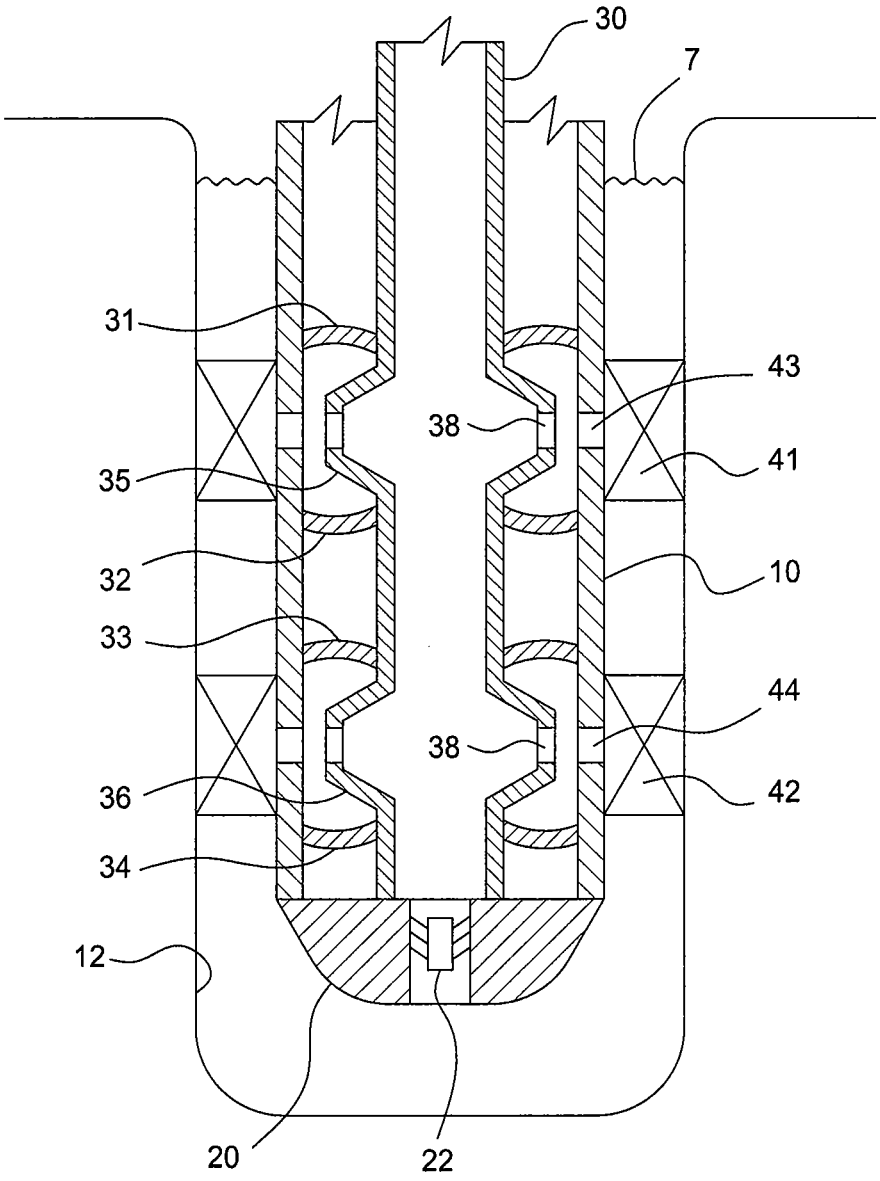

Additional cement is supplied behind the plug 22 to inflate the conductor anchoring assemblies 41, 42. In one embodiment, the upper and lower anchoring assemblies 41, 42 are adapted to inflate sequentially. For example, the upper anchoring assembly 41 is set to inflate at a pressure higher than the lower anchoring assembly 42. Additionally, the lower anchoring assembly 42 is set to inflate at a pressure higher than the pressure during the cementing operation. Referring now to FIG. 3, inflation cement exits drill pipe 30 via the port 38 of the lower enlarged section 36. The exited inflation cement is trapped between the upper and lower sealing assemblies 33, 34 and increases in pressure until the inflation pressure of the lower anchoring assembly 42 is reached.

Figure 4B:
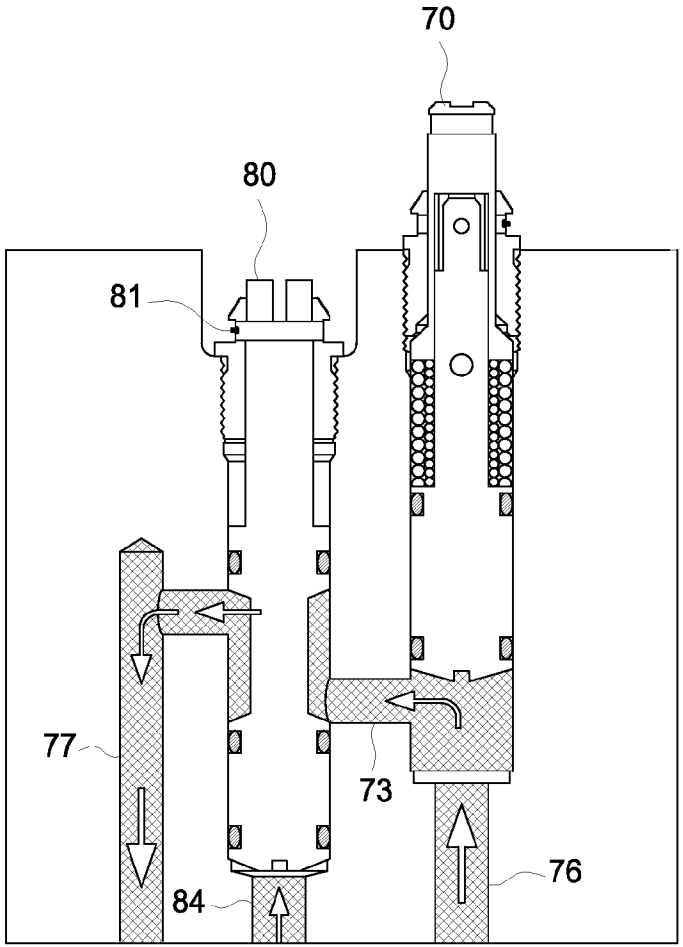
FIGS. 4A-D illustrate sequential operation of the inflating an exemplary anchoring assembly.
Figure 4A:
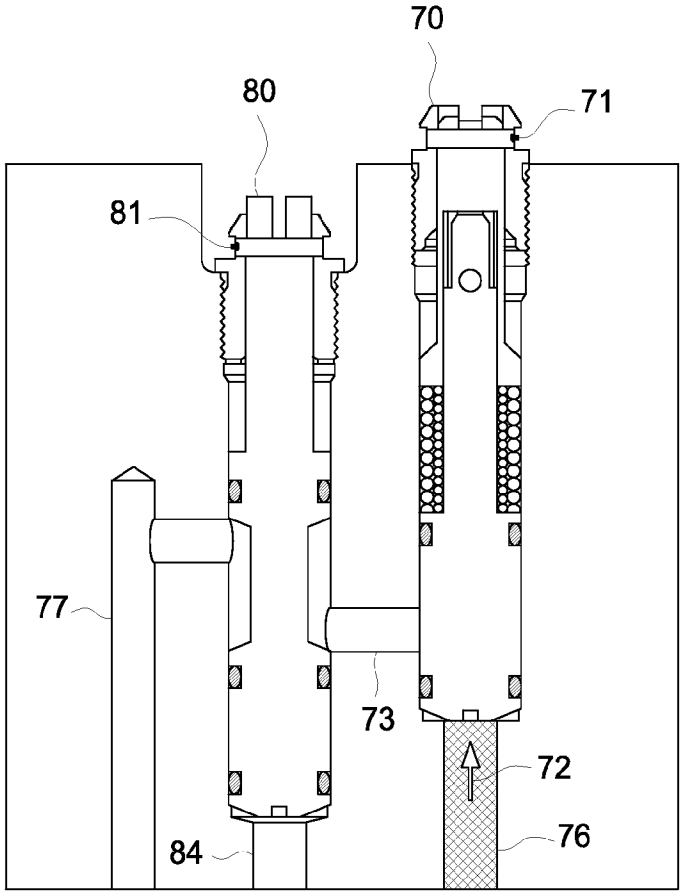
Figure 4D:
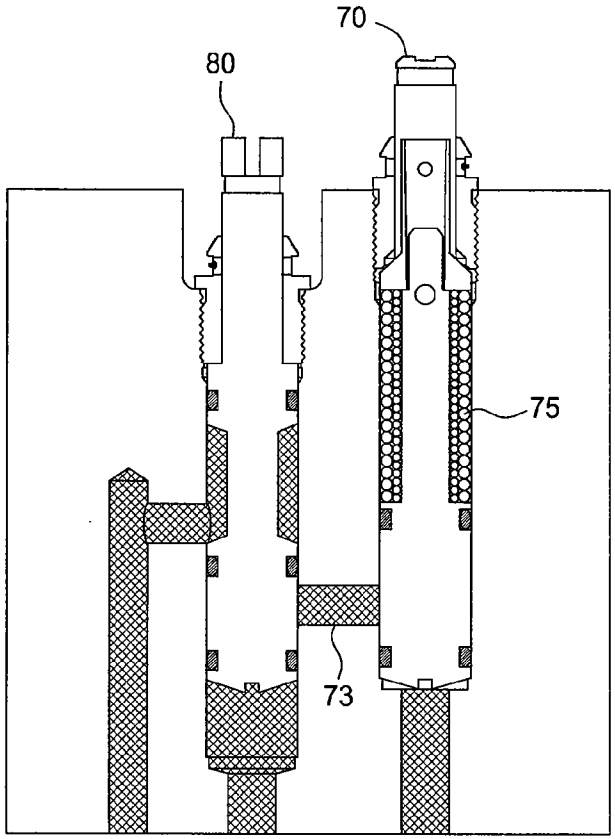
Figure 4C:
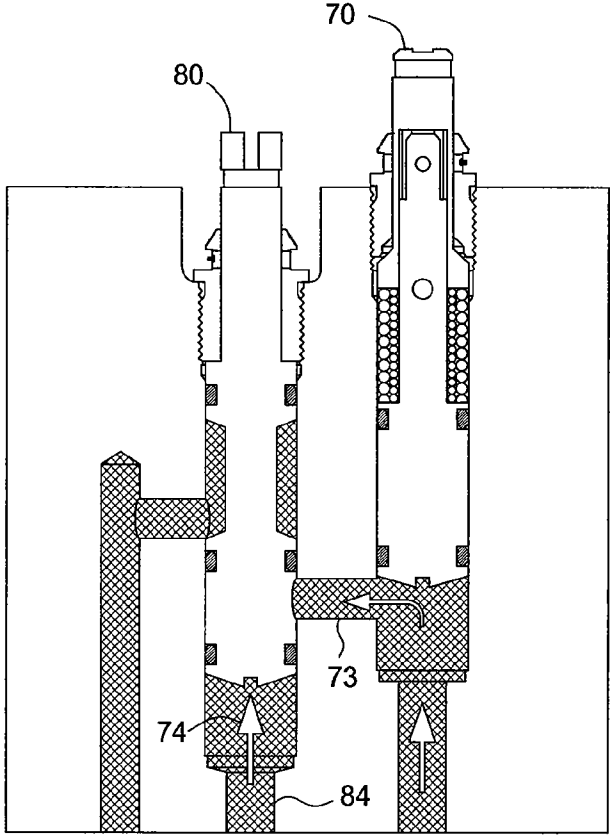

In one embodiment, the anchoring assembly 41, 42 may include an opening valve 70 and a closing valve 80 for controlling inflation, as shown in FIGS. 4A-D. In FIG. 4A, the opening valve 70 is initially maintained in the closed position using a first shear pin 71, and the closing valve 80 is initially in the open position using a second shear pin 81. When the inflation pressure of the lower anchoring assembly 42 is reached, cement 72 entering port 44 and entry path 76 will have sufficient force to break the shear pin 71 of the open valve 70, thereby opening the fluid path 73 to inflate the anchoring assembly 42. FIG. 4B shows the cement being allowed to inflate the anchoring assembly 42. The cement may flow through the entry path 76, flow path 73, closing valve 80, and the element path 77 to inflate the inflatable element of the anchoring assembly 42. The internal pressure of the anchoring assembly 42 will act on the bottom of the closing valve 80 via the closing path 84. When the anchoring assembly 42 is sufficiently inflated, the internal pressure of the anchoring assembly 42 will overcome the shear pin 81 of the closing valve 80, thereby causing the closing valve 80 to move up and close the fluid path 73, as illustrated in the FIG. 4C. It is contemplated that the inflation pressure may be set to cause the inflatable element of the anchoring assembly 42 to press against the borehole wall. In some instances, the inflation pressure may cause the inflation element to form a recess in the wellbore to receive the inflatable element. After the pressure in the drill pipe 30 is relieved, the opening valve 70 is returned to the closed position using a biasing member 75 such as a spring. FIG. 4D shows the opening valve 70 blocking the communication through the flow path 73. The opening valve 70 may be optionally locked into positioned to provide a backup to the closing valve 80.

After the lower anchoring assembly 42 has been inflated, the inflation cement pressure is increased until the inflation pressure of the upper anchoring assembly 41 is reached. The upper anchoring assembly 41 may be inflated using the same procedure described above with respect to the lower anchoring assembly 42. In this manner, both anchoring assemblies 41, 42 may be inflated into contact with the formation, thereby anchoring the conductor 10 in the wellbore 12. In another embodiment, both anchoring assemblies maybe inflated simultaneously. In another embodiment, drilling mud or other fluid may be placed axially between the inflation cement for the upper anchoring assembly and the lower anchoring assembly to conserve the amount of cement used for the inflation procedure.

FIG. 3 shows both conductor anchoring assemblies 41, 42 in the energized state. The energized conductor anchoring assemblies 41, 42 provide additional contact surface area with the borehole. In this respect, the energized anchoring assemblies 41, 42 provide additional stability to the conductor 10 in response to energy such as load and vibration transferred to the conductor 10 or to changes due to temperature. After inflating both anchoring assemblies 41, 42, the drill pipe 30 is unstabbed from the float shoe 20. Excess cement in the drill pipe 30 may be circulated out before the drill pipe is retrieved to surface.

In another embodiment, the drill pipe may include only one set of sealing members 33, 34 positioned proximate the lower anchoring assembly 42. In this respect, the lower end of the drill pipe 30 may include a seat to receive the shut off plug 22. In operation, after the shut off plug 22 closes fluid communication, the inflation cement pressure is increased until the inflation pressure of the lower anchoring assembly 42 is reached. The lower anchoring assembly 42 is then inflated and closed as described above. Thereafter, the drill pipe 30 is disconnected from the float shoe. The shut off plug 22 remains in the drill pipe 30 to close the lower end of the drill pipe 30. The drill pipe 30 is raised until the sealing assembly 33, 34 straddles the inflation port 43 of the upper anchoring assembly 41. The inflation cement pressure is increased until the upper anchoring assembly 41 is inflated. Thereafter, the drill pipe 30 is raised above the sea floor, and the excess cement may be circulated out of the drill pipe 30 through the exit ports 38 in the enlarged section. In another embodiment, the pressure in the drill pipe 30 may be increased to dislodge the shut off plug 22 from the drill pipe 30, thereby allowing the cement to circulate out.

Figure 5:
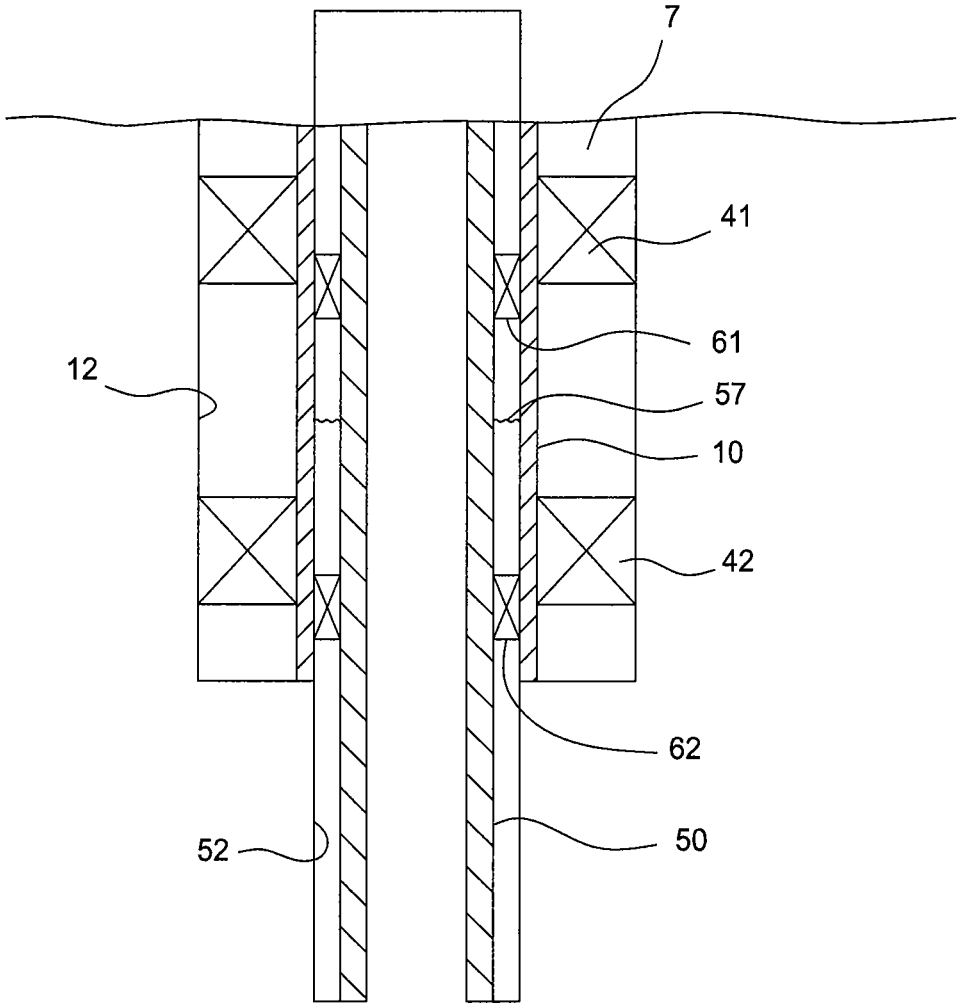
FIG. 5 is a schematic view of a casing string installed in the conductor of FIG. 1 according to another embodiment.

FIG. 5 illustrates an embodiment where one or more casing anchoring assemblies 61, 62 are positioned between the inner surface of the conductor 10 and the exterior surface of a string of casing 50 installed inside the conductor 10. The casing anchoring assemblies may act as load transferring members to transfer energy or forces to the conductor 10, thereby stabilizing the casing 50. The casing anchoring assemblies 61, 62 may be installed using any suitable method described above with respect to the anchoring assemblies 41, 42 of the conductor 10. In one embodiment, the wellbore 52 may be extended using a drill string. The casing 50 is lowered using a drill pipe configured to inflate the casing anchoring assemblies. The casing 50 may be attached to a subsea wellhead. The casing anchoring assembly 61 may be located within 1,000 feet of the sea floor; preferably, within 500 feet; more preferably, within 200 feet. Alternatively, the upper casing anchoring assembly is located at or just below the sea floor. One or more casing anchors may be positioned within or at the same depth as a corresponding conductor anchor. The drill pipe is configured with two sets of sealing members and an enlarged section. During the cementing operation, the cement 57 may optionally, partially fill the annular area between the casing 50 and the conductor 10. After the lower end of the drill pipe is closed off, inflation cement may be supplied to sequentially fill the casing anchoring assemblies 61, 62. Thereafter, the drill pipe may be retrieved. Subsequent casings located within the casing may also have anchors as described herein.

It is contemplated that at least one of the casing anchoring assemblies may be a swellable packer having an elastomeric element. The swellable packer is adapted to delay energizing in the wellbore for a predetermined period of time after contacting the activating fluid, such as water, hydrocarbon, or combinations thereof. In another embodiment, additional strings of casing may be installed concentrically with the conductor and additional casing anchoring assemblies may be used to provide lateral support between the casing strings and the conductor. In another embodiment, the casing anchoring assembly for use as a load transferring member may be a mechanical packer having an elastomeric element. The mechanical packer may be energized by axial compression of the elastomeric element.

The conductor or casing anchoring assembly may be used to transfer loads between, the conductor, casing, and the formation. The load transferred through the anchoring assemblies may have an axial component, a radial component, and/or vibration due to temperature-induced and mechanically-induced loads arising drilling activities, production, and intervention into wellbore. An exemplary non-rigid anchoring assembly is an inflatable anchoring assembly filled with a viscous inflation medium. The non-rigid anchoring assembly may have shock absorbing properties.

Figure 5A:
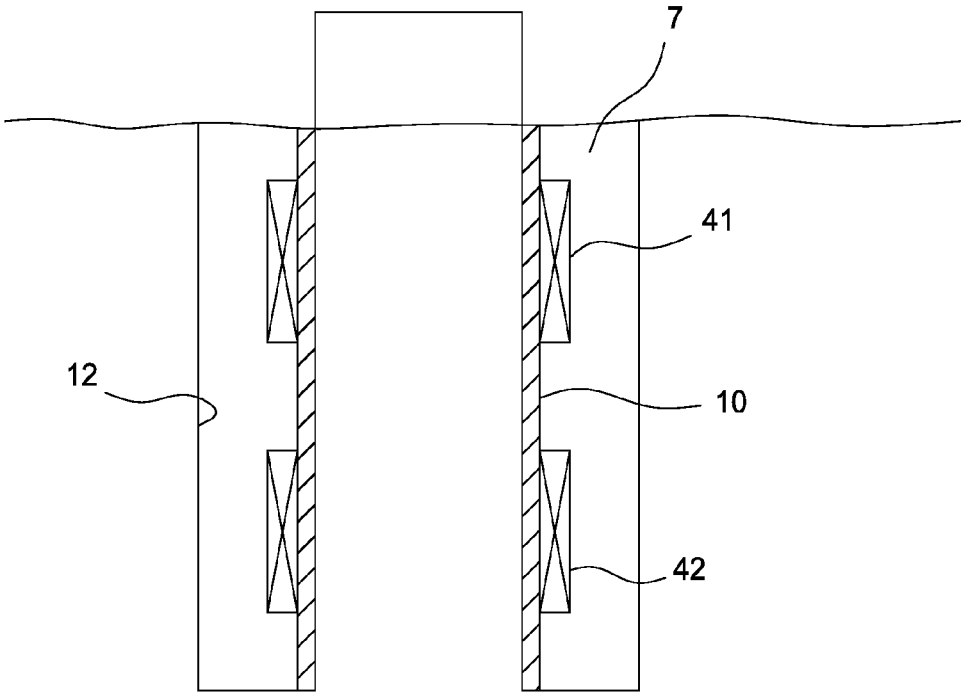
FIG. 5A is a schematic view of the conductor anchoring assemblies of FIG. 5 prior to being energized into contact with a borehole.

FIG. 5A is a schematic view of the conductor anchoring assemblies 41, 42 of FIG. 5 prior to being energized into contact with a borehole 12 using compression force.

Figure 6:
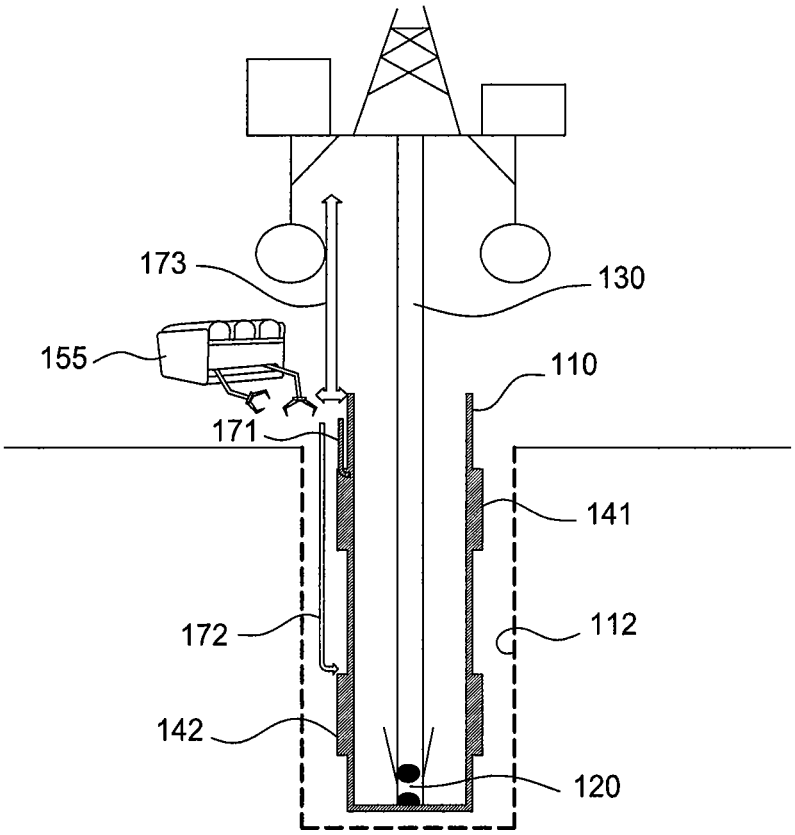
FIG. 6 is a schematic view of another exemplary conductor equipped with a plurality of anchoring assemblies.

FIGS. 6-11 illustrate another embodiment of installing a conductor and associated anchoring assemblies. With reference to FIG. 6, the conductor 110 is positioned in an open borehole 112 using an innerstring 130 attached to the float shoe and valve 120. The conductor 110 is provided with two conductor anchoring assemblies 141, 142 on its exterior. The conductor anchoring assemblies 141, 142 may be inflatable packers, swellable packers, or combinations thereof. A remotely operated vehicle 155 ("ROV") is utilized to connect an inflation cement line 173 from the surface or rig to lines 171, 172 for energizing the anchoring assemblies 141, 142.

In one embodiment, the ROV 155 may operate a three way cement valve to control flow of the cement to and from the anchoring assemblies 141, 142. Although the inflation lines 171, 172 are shown located exterior to the conductor 110, it is contemplated that the inflation lines may be located in the interior of the conductor 110. Locating the inflation lines 171, 172 in the exterior may be advantageous if the conductor 110 has an inner diameter restriction at its upper end which prevents use of the sealing assemblies.

Figure 7:
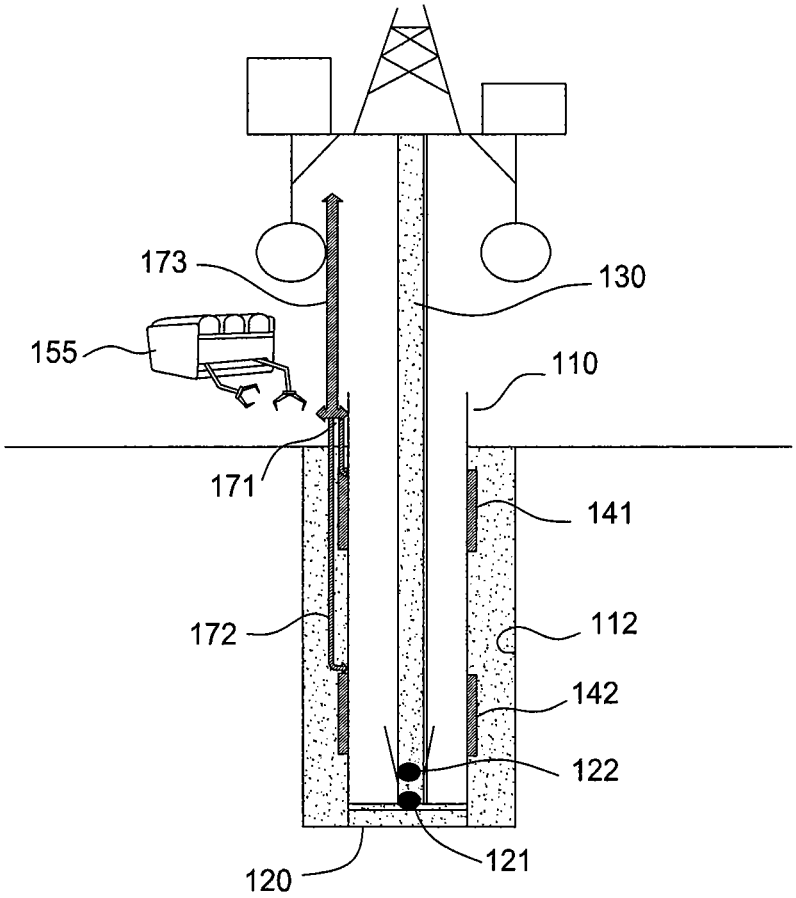
FIGS. 7-11 illustrate sequential operation of installing the conductor of FIG. 6.
Figure 8:
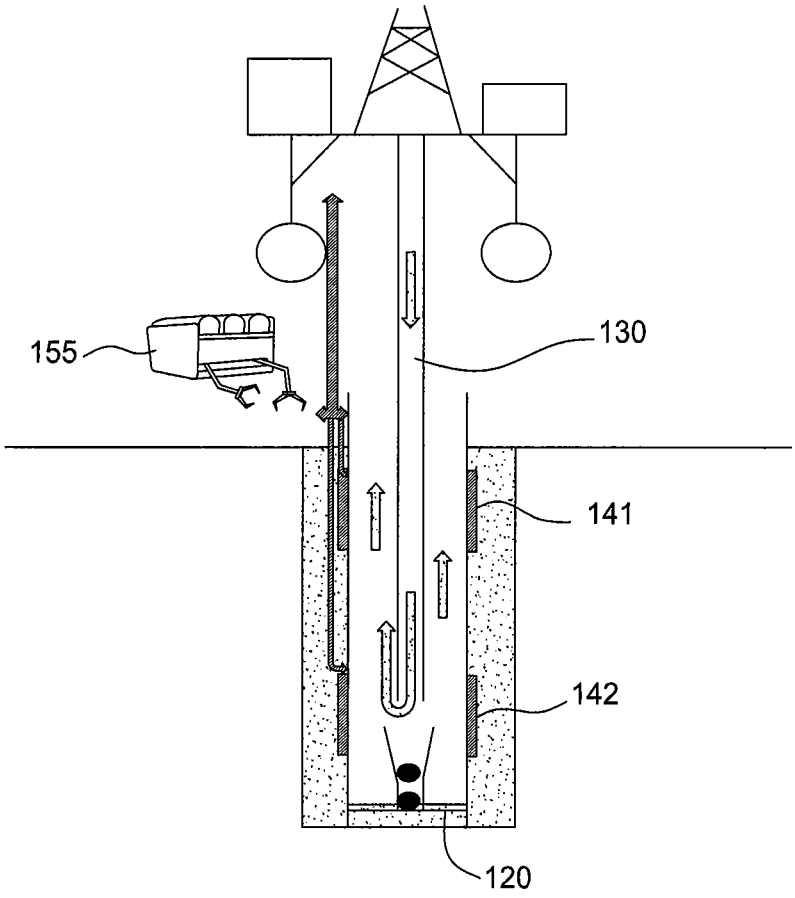
Figure 9:
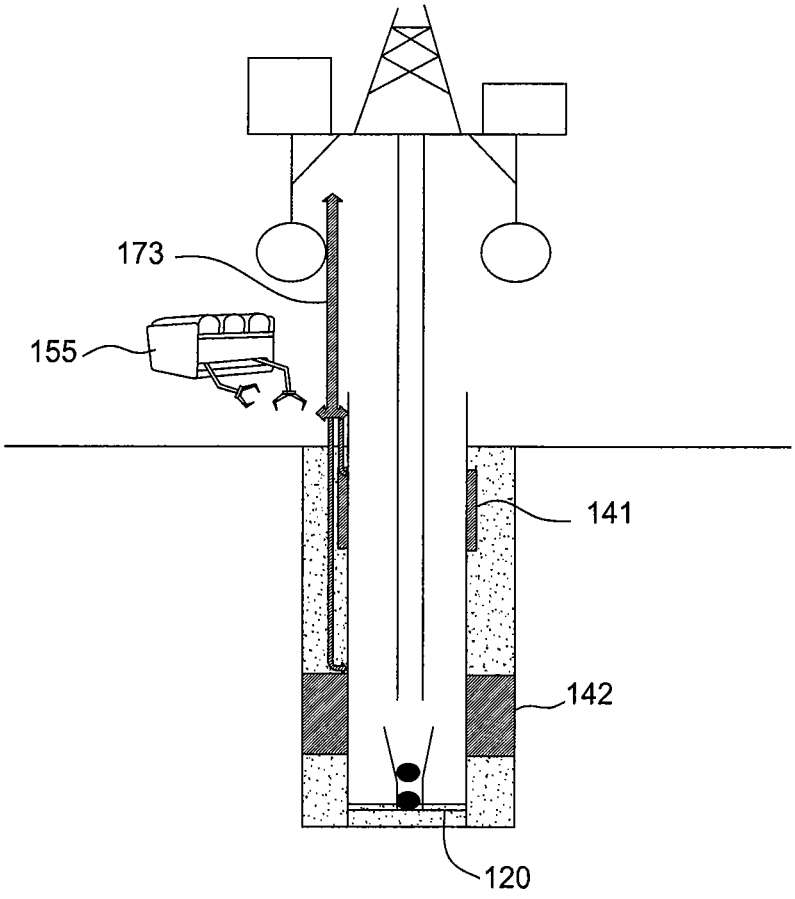
Figure 10:
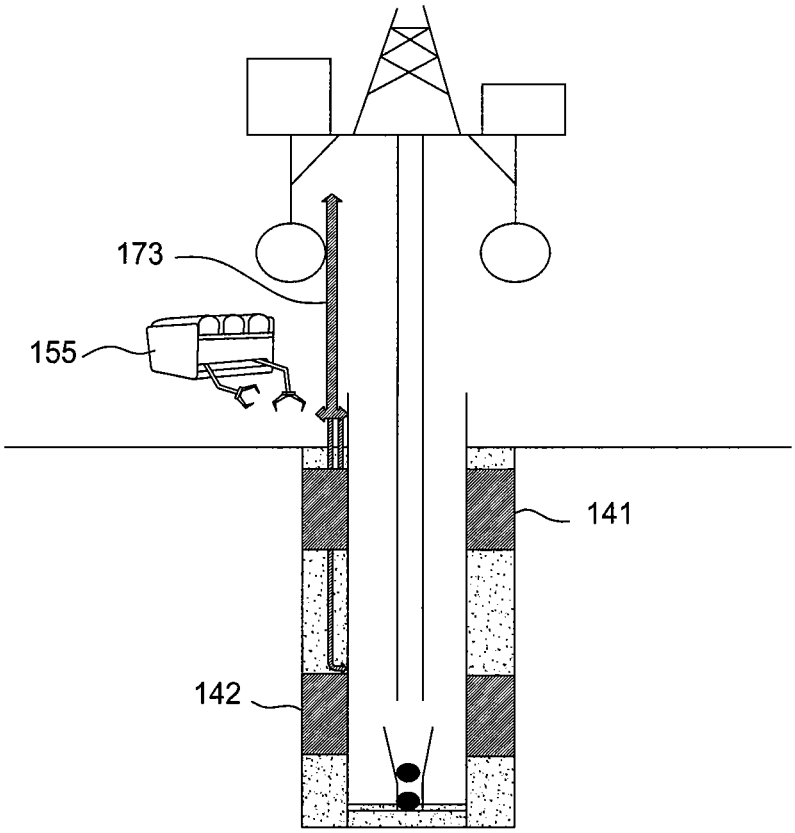
Figure 11:
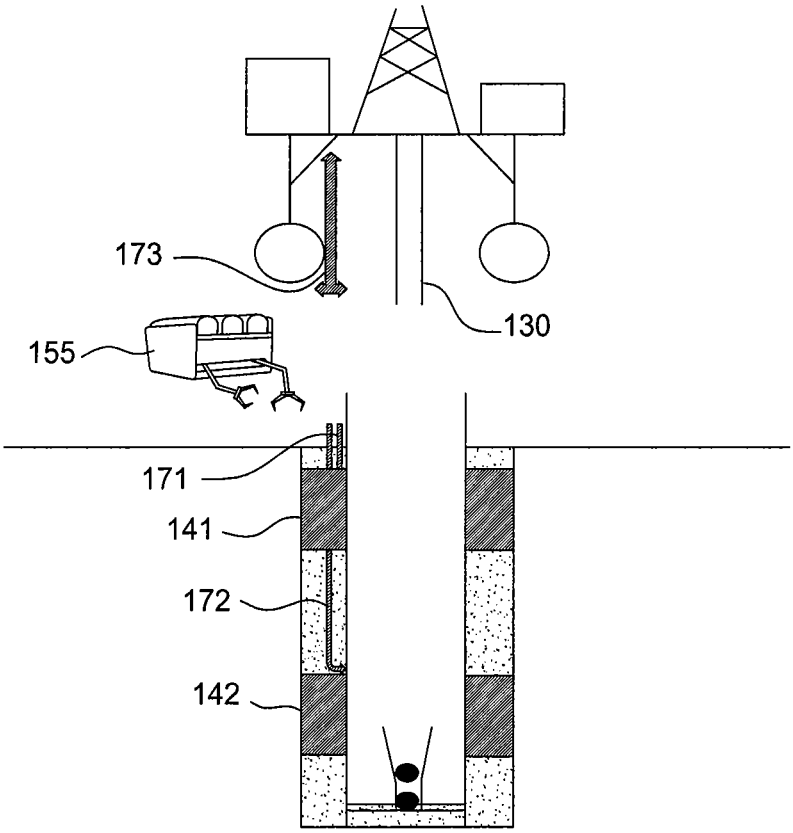

In operation, cement is supplied through the innerstring 130 to fill the annulus, as shown in FIG. 7. A bottom plug or dart 121 is disposed in front of the cement, and a top plug or dart 122 is disposed behind the cement. Preferably, the ROV 155 connects the inflation lines 171, 172 to the inflation cement line 173 before cement fills the annulus. After the bottom plug 121 lands on the float shoe 120, cement pressure behind the bottom plug 121 increases sufficiently to open a flow path through the bottom plug 121 and allow cement to exit the float shoe 120 and fill the annular area. The supply of cement stops when the top plug 122 lands on the bottom plug 121 to close the fluid path. In FIG. 8, the innerstring 130 is disconnected from the float shoe 120 and excess cement is circulated out of the innerstring 130. In FIG. 9, the ROV 155 is operated to direct cement from the inflation cement line 173 to inflate the lower anchoring assembly 142. Thereafter, the ROV 155 directs the cement to inflate the upper anchoring assembly 141, as shown in FIG. 10. After both anchoring assemblies have been inflated, the ROV 155 disconnects the inflation cement line 173 from the inflation lines 171, 172 of the anchoring assemblies 141, 142, as shown in FIG. 11. FIG. 11 also shows the innerstring 130 and the inflation cement line 173 being retrieved.

Although embodiments of the anchoring assembly describe using cement as the inflation medium, other suitable types of inflation media are contemplated. Exemplary inflation media include water, gel, hydrocarbon, swellable elastomers, combinations thereof, or other suitable viscous fluids. For example, swellable elastomer may be placed in the anchoring assembly and allowed to energize when contacted with the appropriate activating fluid. The swellable elastomer may be in powder or granular form. In another example, a solid granular filler material may initially be provided in the anchoring assembly. An exemplary filler material may include a mixture of bentonite (absorbent aluminum silicate clay) and a dry, powdered water soluble polymer such as polyacrylamide, as disclosed in U.S. Pat. No. 3,909,421, which patent is incorporated herein by reference. The filler material may react with the fluid supplied to the anchoring assembly to form a viscous fluid-solid mixture. The filler material may increase in size as it absorbs the fluid. When the filler is a bentonite/polyacrylamide mixture, water may be used as the activating fluid. When mixed with water downhole, a clay is formed, and the water soluble polymer flocculates and congeals the clay to form a much stronger and stiffer cement-like plug. Various filler materials, such as those disclosed in U.S. Pat. Nos. 4,633,950; 4,503,170; 4,475,594; 4,445,576; 4,442,241; and 4,391,925, which are herein incorporated by reference, are also suitable for use without deviating from the embodiments of the present invention.

In another embodiment, a subsea tubular assembly for use in a subsea wellbore below a sea floor includes a conductor; one or more conductor anchoring assemblies disposed on the exterior of the conductor, wherein the one or more conductor anchoring assemblies are energized into contact with the subsea wellbore; a casing string disposed inside the conductor; and one or more casing anchoring assemblies disposed on the exterior of the casing string, wherein the one or more casing anchoring assemblies are energized into contact with the conductor.

In one or more of the embodiments described herein, the one or more casing anchoring assemblies is selected from the group consisting of inflatable packer, swellable packer, mechanical packer, and combinations thereof.

In one or more of the embodiments described herein, the one or more conductor anchoring assemblies are energized using an inflating medium.

In one or more of the embodiments described herein, the inflation medium is selected from the group consisting of water, gel, cement, swellable elastomers, other suitable viscous fluids, and combinations thereof.

In one or more of the embodiments described herein, the one or more conductor anchoring assemblies are energized via contact with an activating medium.

In one or more of the embodiments described herein, the activating medium is selected from the group consisting of water, hydrocarbon, and combinations thereof.

In one or more of the embodiments described herein, the one or more conductor anchoring assemblies are energized using compression force.

While the foregoing is directed to embodiments of the present invention, other and further embodiments of the invention may be devised without departing from the basic scope thereof, and the scope thereof is determined by the claims that follow.

We claim:

1. A subsea tubular assembly for use in a subsea wellbore, comprising:

a conductor extending downward from a sea floor, the conductor being the outermost tubular member in the wellbore, the conductor having one or more openings formed through a sidewall of the conductor;

one or more inflatable anchoring assemblies disposed on an outer surface of the conductor adjacent the one or more openings formed in the conductor; and an innerstring in fluid communication with the conductor and axially moveable relative to the conductor, the innerstring having:

an enlarged section configured to facilitate inflation of the one or more inflatable anchoring assemblies, the enlarged section defined by an enlarged inner diameter and an enlarged outer diameter of the inner string in the area of the sealing members; and one or more openings formed in the enlarged section;

one or more sets of sealing members straddling the one or more openings formed in the enlarged section, the one or more sets of sealing members extending between the innerstring and the conductor.

2. The assembly of claim 1, wherein the sealing members form a seal chamber with the conductor for supplying an inflation medium from the innerstring to the one or more inflatable anchoring assemblies.

3. The assembly of claim 2, wherein the inflation medium is selected from the group consisting of water, gel, cement, hydrocarbon, other suitable fluids, and combinations thereof.

4. The assembly of claim 1, wherein the one or more anchoring assemblies include a swellable elastomer.

5. The assembly of claim 4, wherein the swellable elastomer comprises powder or granular swellable elastomer.

6. The assembly of claim 1, wherein the one or more inflatable anchoring assemblies includes at least an upper anchoring assembly and a lower anchoring assembly axially spaced from the upper anchoring assembly, wherein the lower anchoring assembly is adapted to inflate at a lower pressure than the upper anchoring assembly.

7. The assembly of claim 1, wherein each of the one or more inflatable anchoring assemblies includes an opening valve and a closing valve, the opening valve initially maintained in a closed position using a first shear pin, and the closing valve initially maintained in an open position using a second shear pin.

8. The assembly of claim 1, wherein the one or more openings formed in the enlarged section are radially aligned with the one or more inflatable anchoring assemblies and the one or more openings formed in the conductor.

9. A method of completing a subsea wellbore, comprising:

providing one or more anchoring assemblies on an outer surface of a tubular forming the subsea wellbore, the one or more anchoring assemblies positioned over one or more openings formed in a sidewall of the tubular;

positioning the tubular in the subsea wellbore, the tubular extending downwards from the surface of the wellbore and having a largest diameter of any tubular therein; and supplying fluid through an opening formed in a section of an innerstring having an enlarged inner diameter and an enlarged outer diameter to energize the one or more anchoring assemblies into contact with the subsea wellbore, thereby stabilizing the tubular in the subsea wellbore, wherein the innerstring is axially movable relative to the tubular, and wherein the one or more openings formed through the sidewall of the tubular are straddled by one or more sets of sealing members extending between the innerstring and the tubular.

10. The method of claim 9, wherein the tubular is the outermost tubular.

11. The method of claim 10, further comprising cementing the tubular in the subsea wellbore.

12. The method of claim 10, wherein at least one of the one or more anchoring assemblies is located within 500 feet of the sea floor.

13. The method of claim 9, further comprising:

extending the subsea wellbore;

positioning a second tubular inside the tubular, wherein the second tubular includes a casing anchoring assembly; and energizing the casing anchoring assembly into contact with the tubular.

14. The method of claim 13, wherein the casing anchoring assembly is selected from the group consisting of an inflatable packer, swellable packer, mechanical packer, and combinations thereof.

15. The method of claim 9, wherein the one or more anchoring assemblies is selected from the group consisting of an inflatable packer, swellable packer, and combinations thereof.

16. The method of claim 9, wherein forming the subsea wellbore and positioning the tubular in the subsea wellbore are performed simultaneously.

17. The method of claim 9, wherein the one or more openings formed in the enlarged section are radially aligned with the one or more anchoring assemblies and the one or more openings formed in the tubular.

* * * * *